US009325061B2

(12) United States Patent
Rucki et al.

(10) Patent No.: US 9,325,061 B2
(45) Date of Patent: Apr. 26, 2016

(54) ANTENNA RADOME WITH REMOVEABLY CONNECTED ELECTRONICS MODULE

(71) Applicant: CommScope Technologies LLC, Hickory, NC (US)

(72) Inventors: John S. Rucki, New Providence, NJ (US); Charles J. Buondelmonte, Glen Garnder, NJ (US); Julian R. Colapietro, Center Valley, PA (US); Rajiv Chandrasekaran, Bridgewater, NJ (US)

(73) Assignee: Commscope Technologies LLC, Hickory, NC (US)

( * ) Notice: Subject to any disclaimer, the term of this patent is extended or adjusted under 35 U.S.C. 154(b) by 0 days.

(21) Appl. No.: 14/239,813

(22) PCT Filed: Apr. 17, 2013

(86) PCT No.: PCT/US2013/036949

§ 371 (c)(1),
(2) Date: Feb. 20, 2014

(87) PCT Pub. No.: WO2013/191800

PCT Pub. Date: Dec. 27, 2013

(65) Prior Publication Data

US 2015/0091777 A1 Apr. 2, 2015

Related U.S. Application Data

(60) Provisional application No. 61/663,318, filed on Jun. 22, 2012.

(51) Int. Cl.
*H01Q 1/42* (2006.01)
*H01Q 1/24* (2006.01)

(52) U.S. Cl.
CPC . *H01Q 1/42* (2013.01); *H01Q 1/246* (2013.01)

(58) Field of Classification Search
CPC ..... H01Q 1/02; H01Q 1/42; H01Q 1/28; H01Q 1/246; H01Q 1/1214; H01Q 19/10; H01Q 19/185; H01Q 23/00; H01Q 21/0087; H01Q 21/0025; H01Q 21/12; H01Q 21/06
USPC ..... 343/872, 836, 705, 873, 890, 878
See application file for complete search history.

(56) References Cited

U.S. PATENT DOCUMENTS 7,394,439 B1 * 7/2008 Johnson ..... H01Q 1/1242 343/878
7,642,961 B1 * 1/2010 Rausch ..... H01Q 1/1242 342/367

(Continued)

FOREIGN PATENT DOCUMENTS

DE 20 2009 001821 U1 4/2009
EP 2 343 777 A1 7/2011

OTHER PUBLICATIONS

International Search Report and Written Opinion for PCT/EP2013/036949, completed Jul. 3, 2013, mail date Jul. 10, 2013 (9 pages).

*Primary Examiner* — Lam T Mai
(74) *Attorney, Agent, or Firm* — Myers Bigel & Sibley, P.A.

(57) ABSTRACT

In one embodiment, an antenna assembly in a cellular network has a radome that houses a plurality of antenna arrays and an electronics module. The electronics module has a weatherproof housing that encloses electronics for processing signals received by and transmitted from a first of the antenna arrays. The electronics module is physically removeably connected to an outer surface of the radome and electrically removeably connected to the first antenna array, such that the electronics module can be removed without (i) disrupting service to other antenna arrays and (ii) removing the antenna assembly from the cell tower on which the antenna assembly is installed.

19 Claims, 5 Drawing Sheets

(56) References Cited

U.S. PATENT DOCUMENTS 7,642,988 B1 * 1/2010 Johnson ..... H01Q 1/246 343/872
7,671,801 B2 * 3/2010 Pruett ..... G01S 7/032 342/446
7,881,752 B1 * 2/2011 Johnson ..... H01Q 1/1228 343/872
8,063,837 B1 * 11/2011 Jennings ..... H01Q 1/1214 343/705
8,497,813 B2 * 7/2013 Rodger ..... H01Q 1/02 343/702
2011/0032158 A1 2/2011 Rodger et al.

* cited by examiner

ANTENNA RADOME WITH REMOVEABLY CONNECTED ELECTRONICS MODULE

CROSS-REFERENCE TO RELATED APPLICATIONS

This application claims the benefit of the filing date of U.S. provisional application no. 61/663,318, filed on Jun. 22, 2012, the teachings of which are incorporated herein by reference in their entirety.

BACKGROUND OF THE INVENTION

1. Field of the Invention

The present invention relates to antennas, and, more specifically but not exclusively, to configurations of antenna assemblies in cellular applications.

2. Description of the Related Art

In conventional base-station installations, antenna assemblies and the base-station electronics that interconnect to them are separate physical entities. Antenna assemblies are mounted on cellular towers where they can have unobstructed views of the geographic areas they need to radiate into or receive from. Typically, an antenna assembly comprises one or more antenna arrays located behind a radome. When multiple antenna arrays are used, the antenna arrays may serve different frequency bands. For example, an antenna assembly may contain a first array that serves the 700-900 MHz band and a second array that serves the 1,850-2,170 MHz band. Antenna assemblies that serve multiple frequency bands are often referred to as "multi-band" antennas (or "dual-band" antennas when only two frequency bands are served).

The base-station electronics, such as Remote Radio Heads (RRHs), transmit outgoing (i.e., downlink) cellular electrical signals to the antennas and receive incoming (i.e., uplink) cellular electrical signals from the antennas. Base-station electronics are traditionally located inside a building such as a cell-site but or a small weather-proof enclosure at the base of the cellular tower. In this type of installation, the base-station electronics on the ground are interconnected with the antenna arrays on the tower using radio-frequency (RF) cabling.

As base-station electronics become smaller and more efficient, there is a trend to configure base-station electronics in close proximity to the antenna assemblies. For instance, Ericsson has developed an antenna assembly, referred to as the Antenna-Integrated-Radio (AIR), in which antenna arrays and their associated base-station electronics are all housed within a single radome. This implementation provides for reduced wind loading, better protection of the RF junctions from the elements, and a better aesthetic appearance.

Some cellular phone carriers have favored attempts to configure base-station electronics in close proximity to antenna assemblies. Other carriers, however, have resisted such efforts, preferring instead that the base-station electronics be installed on the ground.

Further, integrating the base-station electronics within the radome may be disadvantageous in situations when the electronics supporting one or more of the antenna arrays fails. In this situation, it may be necessary to (i) open the weatherproof enclosure of the radome to remove the failed electronics module, thereby exposing the other electronics within the radome to the elements, or (ii) remove the radome and associated electronics from the tower altogether. In addition, if the electronics supporting one or more other antenna arrays is still operational, then replacement of the failed electronics may require that service to the one or more other operational antennas be disrupted.

SUMMARY OF THE INVENTION

In one embodiment, the present invention is an apparatus comprising at least one of (1) a radome and (2) an active electronics module. The radome is configured to support mounting of at least one antenna array behind the radome. The active electronics module is configured to process at least one of (i) downlink signals transmitted by the at least one antenna array and (ii) uplink signals received at the at least one antenna array. The apparatus further comprises an electronics module mounting structure configured to support removable attachment of the active electronics module behind the radome, such that: when (i) the radome is mounted to a cell tower and (ii) the active electronics module is mounted behind the radome, the active electronics module can be removed from behind the radome without having to remove the radome from the cell tower.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

Various illustrative embodiments of the disclosure are described herein to facilitate the understanding of the invention as defined in the accompanying claims. Such illustrative embodiments are not meant to limit the scope of the invention, and the invention is not limited to only the exact illustrative embodiments described herein. Thus, a claimed embodiment shall not be interpreted to include a feature or advantage of a described illustrative embodiment, unless that feature or advantage is recited in the claimed embodiment itself. Further, it will be understood that various changes in the details, materials, and arrangements of the parts in the illustrative embodiments which have been described and illustrated in order to explain the nature of the invention may be made by those skilled in the art without departing from the scope of the invention as expressed in the accompanying claims.

To accommodate the preferences of cellular phone carriers that favor the base-station electronics in close proximity to antenna assemblies and those that do not, there is a need for a reconfigurable antenna assembly that permits the electronics serving the antenna array or arrays in the antenna assembly to be selectively located (i) at the base of cell the tower or (ii) in close proximity to the antenna arrays. Further, to accommodate the replacement of a failed electronics module, there is a need for an antenna assembly in which a failed electronics module can be removed from the radome while the radome is still installed on the tower, without (i) exposing the other electronics within the radome to the elements and/or (ii) disrupting service to other operational antennas.

Figure 1:
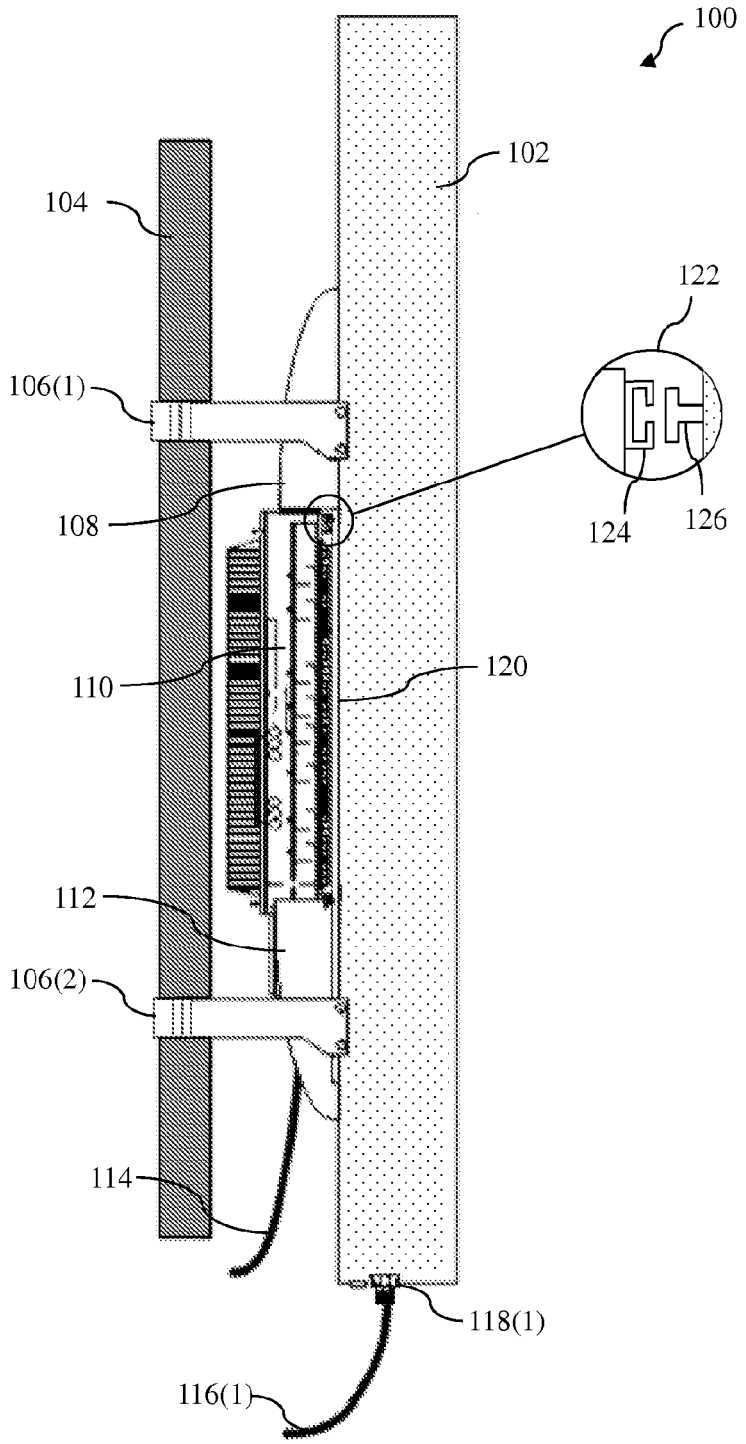
FIG. 1 shows a side view of a cellular antenna assembly according to one embodiment of the disclosure.
Figure 2:
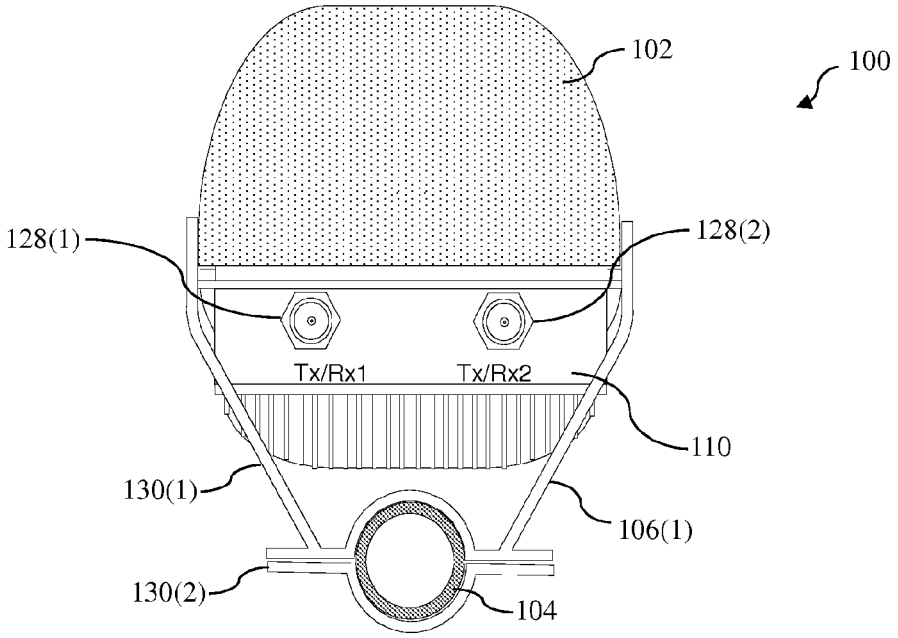
FIG. 2 shows a top view of the cellular antenna assembly of FIG. 1.

FIG. 1 shows a side view of a cellular antenna assembly 100 according to one embodiment of the disclosure, and FIG. 2 shows a top view of cellular antenna assembly 100. Antenna assembly 100 comprises a radome 102, an active electronics module 110, a pipe 104, a pair of brackets 106(1) and 106(2), and optionally, a pair of sheaths 108 and 112. Radome 102, which houses (and generally protects from the elements) a plurality of antenna arrays (not shown), is attached to pipe 104 using brackets 106(1) and 106(2). In FIG. 2, bracket 106(1) is shown as a two-part clamp, having first part 130(1) and second part 130(2), which together clamp around pipe 104; however, numerous other types of brackets may be employed.

Typically, antenna assembly 100 is installed by sliding pipe 104 over a mating pole or pipe (not shown) on a cell tower, such that the mating pole or pipe (not shown) rests inside pipe 104. Note that, as used herein, the term "cell tower" is used to refer to an elevated structure on which a cellular antenna is mounted, including, but not limited to, actual towers, tops of buildings, water towers, and high-tension towers. Further, the term "cell-tower mounting structure" refers to the structure used to mount the antenna assembly to the tower. In this embodiment, the cell-tower mounting structure is formed by brackets 106(1) and 106(2) and pipe 104; however, according to alternative embodiments, other cell-tower mounting structure may be used.

Active electronics module 110 comprises electronics that process signals provided to, and received from, at least one of the antenna arrays in radome 102. As used herein, the term "active electronics" refers to electronics that purposefully modifies at least one of (i) uplink signals received from an antenna array and (ii) downlink signals radiated by an antenna array. Active electronics are distinguished from passive electronics, such as antenna elements, which might or might not incidentally modify the uplink and/or downlink signals. Further, electronics module 110 comprises an outer weatherproof housing that protects the electronics contained therein from the elements. As will be described below, electronics module 110 is (i) physically removeably connected to an outer surface 120 of radome 102 and (ii) electrically removeably connected to at least one of the antenna arrays within radome 102. As a result, electronics module 110 may be safely removed from antenna assembly 100 (i) while antenna assembly 100 is installed on a tower and, depending on the particular electrical configuration, (ii) without disturbing service to all of the antenna arrays in radome 102. Antenna assembly 100 can be shipped from a factory to the installation site as one unit, ready for installation on the cell tower, or as separate parts that are attached together to form antenna assembly 100 at the installation site by an installer.

Figure 4:
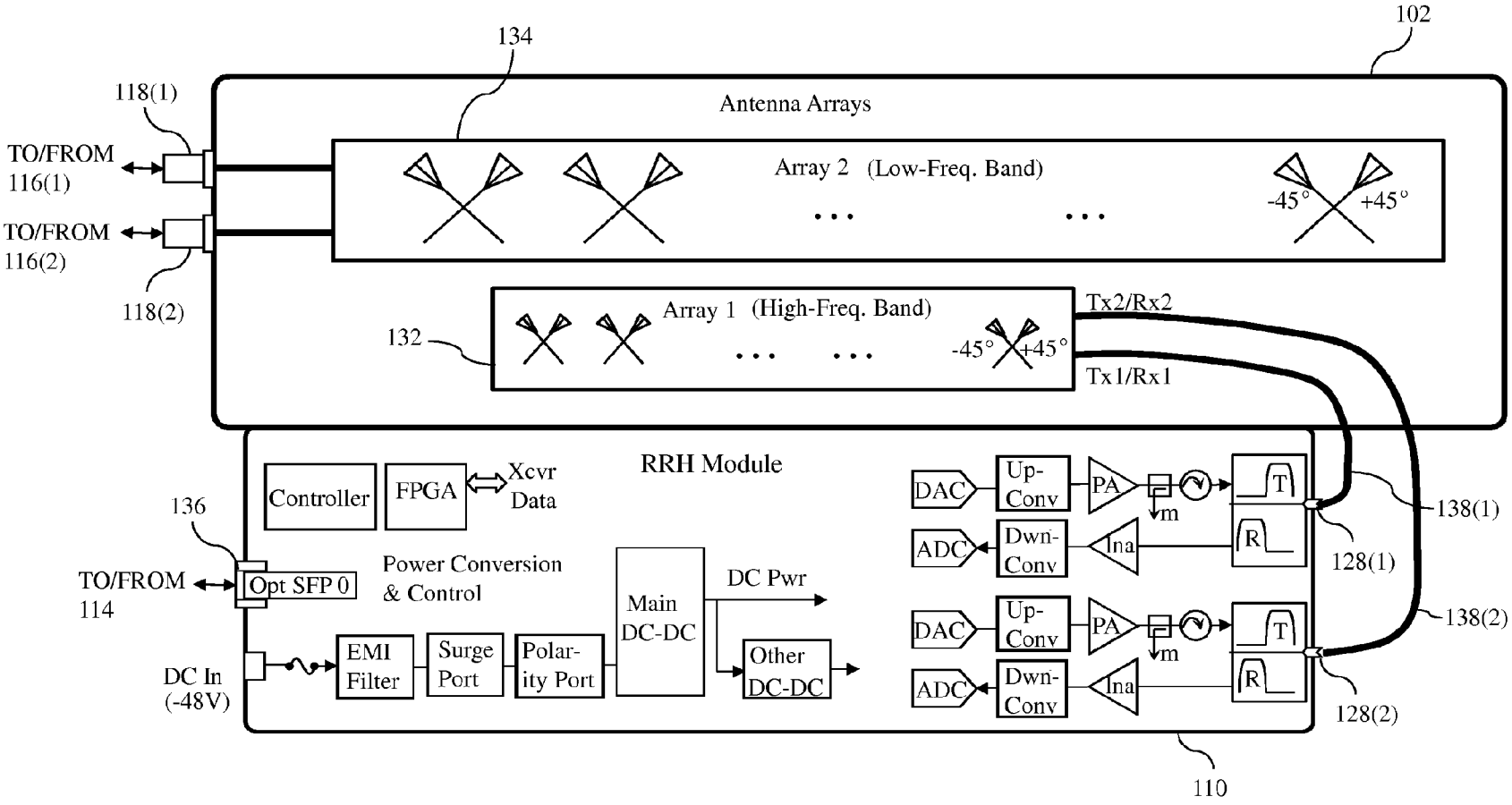
FIG. 4 shows a simplified schematic block diagram of the antenna assembly of FIG. 1 according to one embodiment of the disclosure.

FIG. 4 shows a simplified schematic block diagram of antenna assembly 100 according to one embodiment of the disclosure. In this embodiment, antenna assembly 100 is a dual-band antenna assembly comprising first and second antenna arrays 132 and 134 housed within radome 102. First antenna array 132 serves a high-frequency band (e.g., 1710 MHz to 2155 MHz) and second antenna array 134 serves a low-frequency band (e.g., 698 MHz to 896 MHz). Each antenna array has antenna elements for communicating in a dual-polarized mode, wherein half of the antenna elements in the array transmit and receive using a first polarization (e.g., +45°) and the remaining half of the antenna elements in the array transmit and receive using a second polarization (e.g., −45°). Note that first and second antenna arrays 132 and 134 are merely passive devices that radiate and receive signals, without actively modifying the signals.

First antenna array 132 is served by active electronics module 110, the housing of which, as described above, is physically removeably connected to radome 102. Electronics module 110 is also electrically removeably connected to first antenna array 132 via RF connectors 128(1) and 128(2) of electronics module 110 and RF cables 138(1) and 138(2). Further, electronics module 110 is electrically connected to equipment at the base of the cell tower (not shown) via optical cable 114, which is removeably connected to optical connector 136 of radome 102.

RF cables 138(1) and 138(2) and RF connectors 128(1) and 128(2) may be protected from the elements (i.e., weatherproofed) using sheath 108 shown in FIG. 1. Similarly, optical connector 136 and the portion of optical cable 114 that connects to optical connector 136 may be protected from the elements using sheath 112 shown in FIG. 1. Sheaths 108 and 112 are configured to slide out of the way to allow access for connecting and disconnecting the respective cables at connectors 128(1), 128(2), and 136.

Returning to FIG. 4, in the downlink direction, electronics module 110 receives a baseband downlink communications signal via cable 114 and prepares the baseband signal for transmission. In particular, electronics module 110 generates a pair of dual-polarized transmission signals (i.e., TX1 and TX2) from the baseband signal using processing such as, but not limited to, optical-to-electrical conversion, digital-to-analog conversion (DAC), up-conversion to the radio frequency, and power-amplification (PA). The dual-polarized downlink signals TX1 and TX2 are provided to first antenna array 132 via RF cables 138(1) and 138(2), respectively.

In the uplink direction, electronics module 110 receives dual-polarized uplink signals RX1 and RX2 from first antenna array 132 via RF cables 138(1) and 138(2), respectively. Electronics module 110 performs processing to generate a single baseband signal that is provided to the base-station below (not shown) via optical cable 114. In particular, electronics module 110 generates the baseband signal using processing such as, but not limited to, low-noise amplification (LNA), frequency down-conversion, analog-to-digital conversion (ADC), combining of the dual-polarized signals, and electrical-to-optical conversion.

Second antenna array 134 is served by a second electronics module (not shown) that is installed on the ground at the base station. The second electronics module (not shown) performs operations similar to those of electronics module 110 to (i) generate dual-polarized signals for transmission by second antenna array 134 in the downlink direction and (ii) generate a combined base-band signal from a pair of dual-polarized signals received by second antenna array 134 in the uplink direction. The dual-polarized signals are transferred between second antenna array 134 and the second electronics module using a pair of RF cables 116(1) and 116(2) (only one of which is shown in FIG. 1), which are removeably connected to RF connectors 118(1) and 118(2) of radome 102, respectively.

Figure 3:
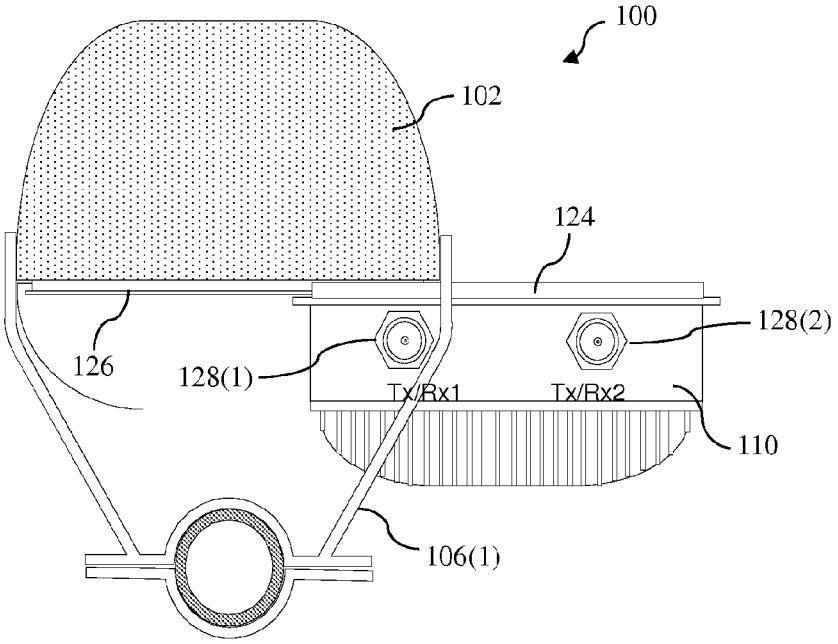
FIG. 3 shows a top view of the antenna assembly in FIG. 1 with the electronics module partially removed.

FIG. 3 shows a top view of antenna assembly 100 with electronics module 110 partially removed. Note that, for ease of illustration, sheath 108 and RF cables 138(1) and 138(2) are not shown. To remove electronics module 110, RF cables 138(1) and 138(2) are disconnected from RF connectors 128(1) and 128(2). Electronics module 110 is then removed from radome 102 by sliding electronics module 110 out from between radome 102 and pipe 104 in a direction that is perpendicular to the axis of pipe 104 (i.e., out the side). Note that this operation can be performed by a single worker, while radome 102 remains installed on the cell tower, without disrupting service to second antenna array 134.

Electronics module 110 is removeably connected to radome 102 using electronics module mounting structure. In this embodiment, the electronics module mounting structure on radome 102 is formed by fastener 126, which is attached to radome 102, and the electronics module mounting structure on electronics module 110 is formed by fastener 124, which is attached to electronics module 110. As shown in detail 122 of FIG. 1 and in FIG. 3, fastener 126 is a protrusion extending across the width of radome 102 having a T-shaped cross-section, and fastener 124 is a channel protruding across the width of electronics module 110 having a cutout with a T-shaped cross-section for receiving fastener 126.

According to other embodiments, electronics module 110 and radome 102 may be removeably connected using other types of mounting structures, including other types of fasteners. It is preferred, but not required, that such other types of fasteners provide a quick release and permit electronics module 110 and radome 102 to be mated to one another blindly. Further, the fasteners can be standardized such that installers can selectively and independently configure (and, if appropriate, re-configure) each different antenna array either as an active antenna with a corresponding electronics module behind the radome or as a passive antenna with its electronics module located at the base of the cell tower.

Referring back to FIG. 4, note that disconnecting RF cables 138(1) and 138(2) does not disturb the service provided to second antenna array 134 by RF cables 116(1) and 116(2). Therefore, second antenna array 134 can continue to operate as electronics module 110 is removed and possibly replaced with another electronics module (installed with radome 102 or at the base station on the ground).

Figure 5:
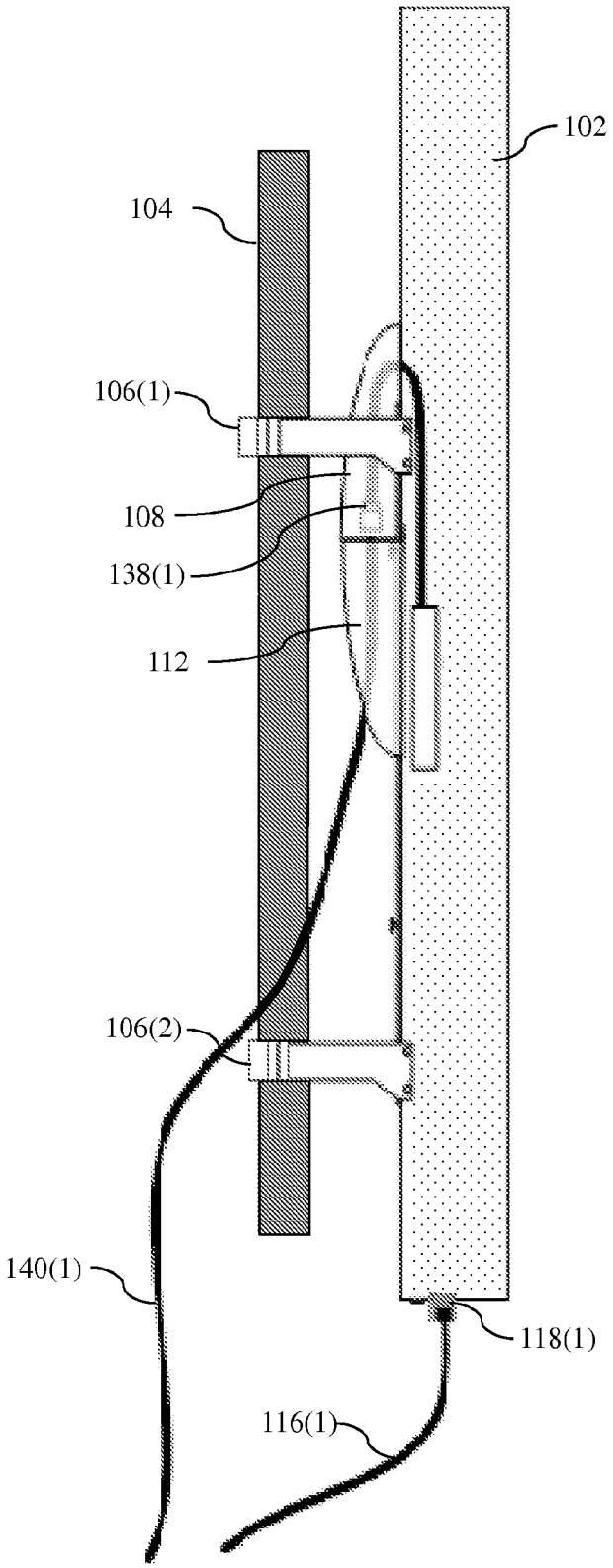
FIG. 5 shows a side view of the antenna assembly of FIG. 1 with the electronics module completely removed.

FIG. 5 shows a side view of antenna assembly 100 without electronics module 110 installed. As shown, first antenna array 132 can also be served by an electronics module (not shown) that is located at the base of the cell tower by connecting RF cables 140(1) and 140(2) (only one of which is shown in FIG. 5) to cables 138(1) and 138(2), respectively. The electronics module at the base of the cell tower may be electronics module 110 or another electronics module designed for installation at the base of the cell tower. In this configuration, antenna assembly 100 is merely a passive antenna device that radiates and receives signals without actively modifying the signals.

Although one embodiment of the disclosure has been shown which serves two specific and different frequency bands, embodiments of the disclosure are not so limited. According to alternative embodiments, antenna assemblies of the disclosure may serve as few as one frequency band or more than two frequency bands. In the case of one frequency band, one electronics module may serve the frequency band or two or more modules may serve the same frequency band. Further, antenna assemblies of the disclosure may serve frequency bands other than the exemplary frequency bands described above.

According to alternative embodiments, antenna assemblies of the disclosure may support a single polarization or more than two polarizations of a signal to be communicated.

Figure 6:
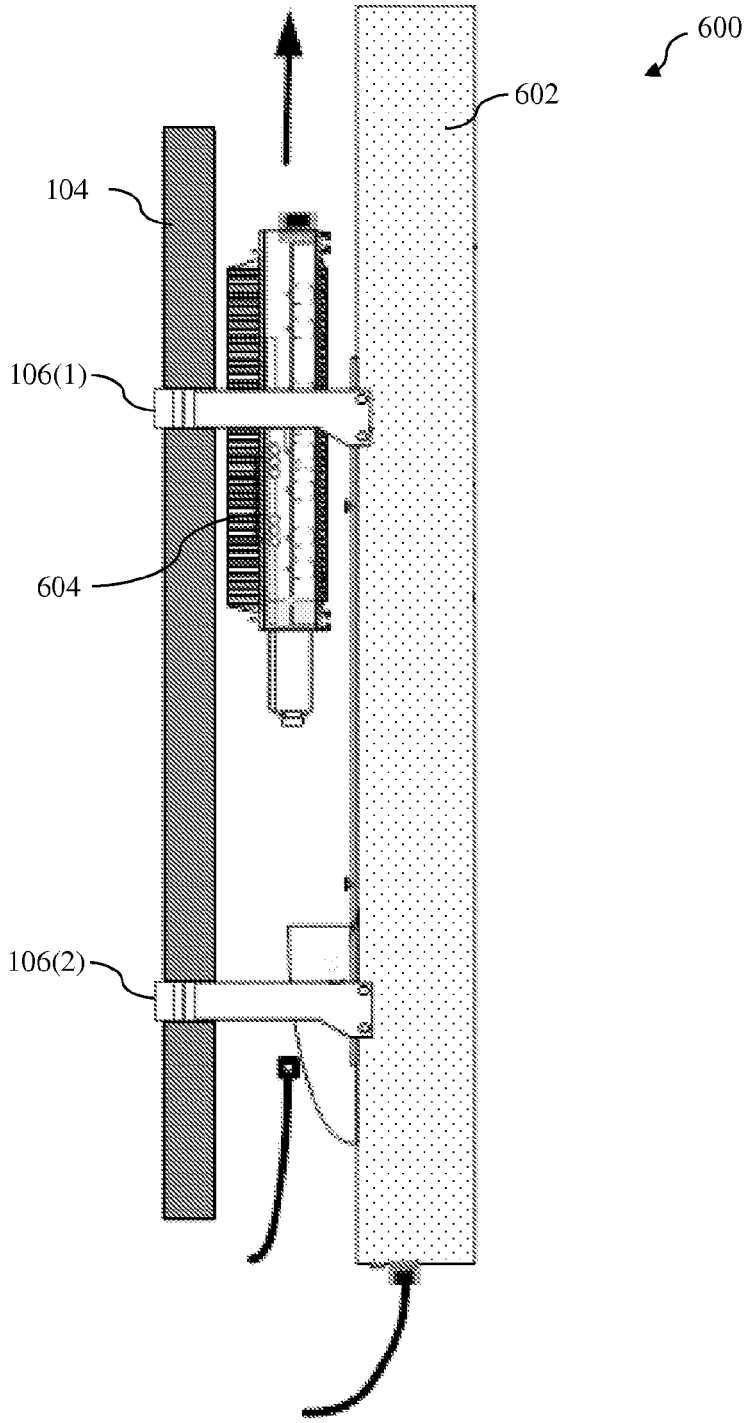
FIG. 6 shows a side view of a cellular antenna assembly according to another embodiment of the disclosure.

Further, although one embodiment of the disclosure has been shown that has a single electronics module that is removable from the side of the radome, embodiments of the disclosure are not so limited. According to alternative embodiments, antenna assemblies of the disclosure may implement more than one electronics module that is removably connected to the radome, and electronics modules that are removable towards the top or bottom of the radome. For instance, FIG. 6 shows a side view of a cellular antenna assembly 600 according to one embodiment of the disclosure in which an electronics module 604 is removable towards the top of the radome 602. Note that, to accommodate removal towards the top of radome 602, fasteners other than fasteners 124 and 126 may be used.

According to alternative embodiments, antenna assemblies of the disclosure may support multi-mode communications, wherein the antenna arrays support two or more different radio-access technologies.

Although electronics module 110 was described as being removeably attached to radome 102, embodiments of the disclosure are not so limited. According to alternative embodiments, electronics modules of the disclosure may be removeably attached to another surface between the cell-tower mounting structure and the radome. For example, electronics modules of the disclosure may be removeably attached to brackets 106(1) and 106(2) and/or pipe 104.

According to some embodiments of the disclosure, primary and backup electronics modules may be removeably attached between the cell-tower mounting structure and the radome. Ordinarily, the primary electronics module may serve one or more antenna arrays behind the radome. If and when the primary electronics module fails, the backup electronics module may supply service to the one or more antenna arrays.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

For purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. An apparatus comprising a radome and (2) an active electronics module, wherein:

the radome is configured to support mounting of at least one antenna array behind the radome;

the active electronics module is configured to process at least one of (i) downlink signals transmitted by the at least one antenna array and (ii) uplink signals received at the at least one antenna array, wherein the apparatus further comprises an electronics-module mounting structure including a first reusable fastener, the electronics-module mounting structure configured to support removable attachment of the active electronics module behind the radome, such that if the radome is mounted to a cell tower with the active electronics module removably attached behind the radome, then the active electronics module can be removed from behind the radome without removing the radome from the cell tower.

2. The apparatus of claim 1, wherein, after the active electronics module has been removed from behind the radome, another active electronics module can be removably attached behind the radome without removing the radome from the cell tower.

3. The apparatus of claim 1, wherein:

the electronics-module mounting structure further comprises a second reusable fastener complementary to the first reusable fastener;

the radome comprises one of the first and second reusable fasteners; and the active electronics module comprises the other of the first and second reusable fasteners.

4. The apparatus of claim 1, wherein:

the active electronics module is slidably attached behind the radome.

5. The apparatus of claim 3, wherein:

the first reusable fastener is an elongated protrusion and the second reusable fastener is a complementary channel; and the channel is configured to receive the elongated protrusion.

6. The apparatus of claim 1, wherein:

the apparatus comprises the at least one antenna array mounted behind the radome; and the active electronics module is removable from behind the radome without exposing the at least one antenna array to an environment outside of the radome.

7. The apparatus of claim 6, wherein the active electronics module comprises:

circuitry configured to process at least one of (i) the downlink signals and (ii) the uplink signals; and a housing, separate from the radome, configured to house the circuitry.

8. The apparatus of claim 7, wherein:

the housing is weatherproof; and the active electronics module is configured to be removable from behind the radome without exposing the circuitry to an environment outside of the housing.

9. The apparatus of claim 1, wherein:

the apparatus comprises at least first and second antenna arrays mounted behind the radome;

the active electronics module is configured to process at least one of (i) downlink signals transmitted by the first antenna array and (ii) uplink signals received at the first antenna array; and the active electronics module is configured to be removable from the apparatus without disturbing service to the second antenna array.

10. The apparatus of claim 9, wherein:

the apparatus further comprises at least one other active electronics module;

the at least one other active electronics module is configured to process at least one of (i) downlink signals transmitted by the second antenna array and (ii) uplink signals received at the second antenna array;

the at least one other active electronics module is attached behind the radome; and the active electronics module is configured to be removable from the apparatus without disturbing service provided by the at least one other active electronics module to the second antenna array.

11. The apparatus of claim 9, wherein:

the second antenna array is served by at least one base-station electronics module configured to process at least one of (i) downlink signals transmitted by the second antenna array and (ii) uplink signals received at the second antenna array;

the at least one base-station electronics module is installed at a base of the cell tower; and the active electronics module is configured to be removable from behind the radome without disturbing service provided by the at least one base-station electronics module to the second antenna array.

12. The apparatus of claim 1, wherein:

the apparatus comprises the at least one antenna array mounted behind the radome;

the apparatus is installed on the cell tower; and the at least one antenna array is served by a base-station electronics module installed at a base of the cell tower.

13. The apparatus of claim 1, wherein the apparatus comprises cell-tower mounting structure,comprising:

a pole; and at least one bracket configured to attach the radome to the pole.

14. The apparatus of claim 1, wherein:

the apparatus comprises the first antenna array and a second antenna array;

the active electronics module is configured to process at least one of (i) downlink signals transmitted by the first antenna array and (ii) uplink signals received at the first antenna array; and the active electronics module comprises:

circuitry configured to process at least one of (i) the downlink signals and (ii) the uplink signals; and a housing, separate from the radome, configured to house the circuitry, wherein:

the housing of the active electronics module is removeably attached to the radome using the electronics module mounting structure; and the active electronics module is configured to be removed from behind the radome without disturbing service to the second antenna array.

15. The apparatus of claim 1, wherein:

the apparatus has a radome side on which the radome is mounted; and the apparatus is configured to provide access to the active electronics module from a side other than the radome side such that the active electronics module can be removed without disturbing the radome side.

16. An apparatus comprising (1) a radome and (2) an active electronics module, wherein:

the radome is configured to support mounting of at least one antenna array behind the radome;

the active electronics module is configured to process at least one of (i) downlink signals transmitted by the at least one antenna array and (ii) uplink signals received at the at least one antenna array, wherein the apparatus further comprises an electronics module mounting structure configured to support removable attachment of the active electronics module behind the radome, such that:

when (i) the radome is mounted to a cell tower and (ii) the active electronics module is mounted behind the radome, the active electronics module can be removed from behind the radome without having to remove the radome from the cell tower the radome comprises the electronics module mounting structure, wherein the electronics module mounting structure is configured to support removable attachment of the active electronics module behind the radome; and the active electronics module comprises a mating electronics module mounting structure configured to mate with the electronics module mounting structure to support removable attachment of the active electronics module behind the radome.

17. The apparatus of claim 16, wherein the active electronics module is removeably attached to the radome using the electronics module mounting structure and the mating electronics module mounting structure.

18. An apparatus comprising (1) a radome and (2) an active electronics module, wherein:

the radome is configured to support mounting of at least one antenna array behind the radome;

the active electronics module is configured to process at least one of (i) downlink signals transmitted by the at least one antenna array and (ii) uplink signals received at the at least one antenna array, wherein the apparatus further comprises an electronics module mounting structure configured to support removable attachment of the active electronics module behind the radome, such that:

when (i) the radome is mounted to a cell tower and (ii) the active electronics module is mounted behind the radome, the active electronics module can be removed from behind the radome without having to remove the radome from the cell tower;

the apparatus comprises the at least one antenna array mounted behind the radome;

the active electronics module is configured to be removable from behind the radome without exposing the at least one antenna array to an environment outside of the radome; and the active electronics module comprises:

circuitry configured to process at least one of (i) the downlink signals and (ii) the uplink signals; and a housing, separate from the radome, configured to house the circuitry.

19. The apparatus of claim 18, wherein:

the housing is weatherproof; and the active electronics module is configured to be removable from behind the radome without exposing the circuitry to an environment outside of the housing.

* * * * *